United States Patent [19]

Thaheld et al.

[11] 4,006,694

[45] Feb. 8, 1977

[54] HAND HELD TUFTING MACHINE

[75] Inventors: Fred A. Thaheld; Fred H. Thaheld, both of Minden, Nev.

[73] Assignee: Rumplestiltskin's Craft Shop, Inc., Portland, Oreg.

[22] Filed: June 12, 1975

[21] Appl. No.: 586,264

[52] U.S. Cl. ..... 112/80

[51] Int. Cl.[2] ..... D05C 15/06

[58] Field of Search ..... 112/79.5, 80, 48, 89, 112/169

[56] References Cited

UNITED STATES PATENTS

| | | | |
|---|---|---|---|
| 1,932,516 | 10/1933 | Gilleland | 112/80 |
| 2,007,356 | 7/1935 | Webster | 112/80 |
| 2,635,567 | 4/1953 | Drake | 112/80 |
| 2,887,076 | 5/1959 | Sterner | 112/80 |

FOREIGN PATENTS OR APPLICATIONS

| | | | |
|---|---|---|---|
| 674,501 | 6/1952 | United Kingdom | 112/80 |

*Primary Examiner*—H. Hampton Hunter
*Attorney, Agent, or Firm*—Lyon & Lyon

[57] ABSTRACT

A tufting machine employs a manual crank and gearing on one side of a support plate for driving a rotary eccentric and a crank arm on the other side. The rotary eccentric causes orbital motion of the upper end of a body, and a hollow needle fixed to the body is guided in a stationary ring fixed to the support plate. The crank arm is connected by a link to a slide block guided for movement longitudinally of the body. A solid needle fixed to the slide block has a lower end which moves above and below the yarn entrance window near the lower end of the hollow needle. A grip handle at the upper end of the support plate enables the device to be manually tilted to control the length of the stitch.

2 Claims, 5 Drawing Figures

HAND HELD TUFTING MACHINE

This invention relates to tufting machines of the type employing concentric needles to form tufts of yarn on one side of the backing strip. A motor operated device of this general character is shown in the copending application of Fred A. Thaheld, et al, Ser. No. 231,257 filed Mar. 2, 1972, now abandoned. It is an object of this invention to provide a tufting machine capable of producing the same type of work as the device shown in the copending application, but without requiring an electric motor. The motor adds weight to the assembly, and in some remote locations electric power is not available.

A feature of the present invention is that a well-balanced hand powered tool is provided in which the hand crank and gearing are mounted on one side of a central support plate while concentric needles and their driving mechanism is mounted on the other side. A grip handle at the upper end of the support plate employs oppositely extending projections, so that one hand of the user may be employed to support the device and control its motions with respect to a backing strip, while the other hand of the user may be employed on a hand crank to drive the gearing.

Other and more detailed objects and advantages will appear hereinafter.

Figure 1:
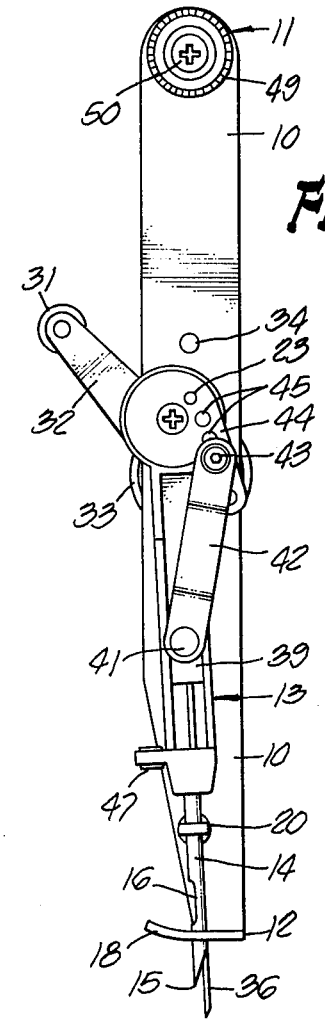
FIG. 1 is a side elevation showing a preferred embodiment of this invention.
Figure 2:
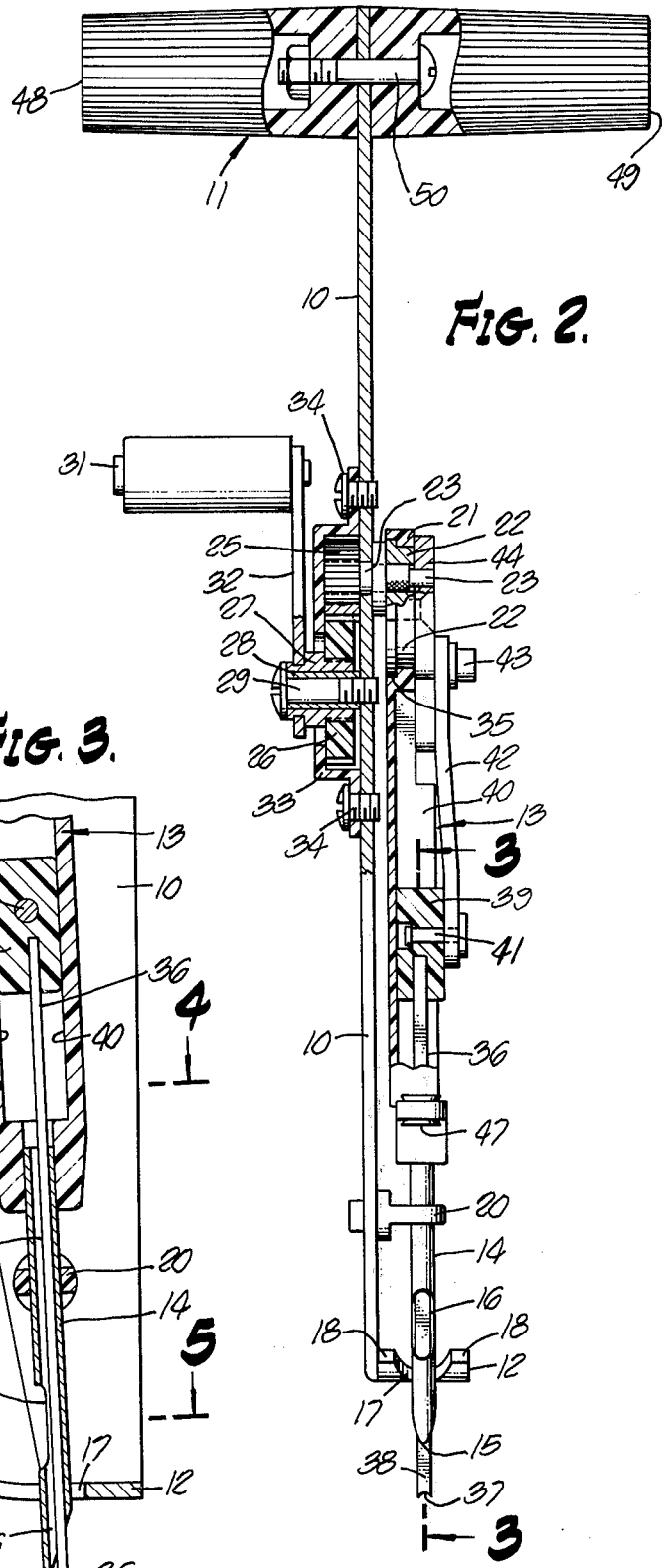
FIG. 2 is an end elevation partly in section, and shown on a larger scale.
Figure 3:
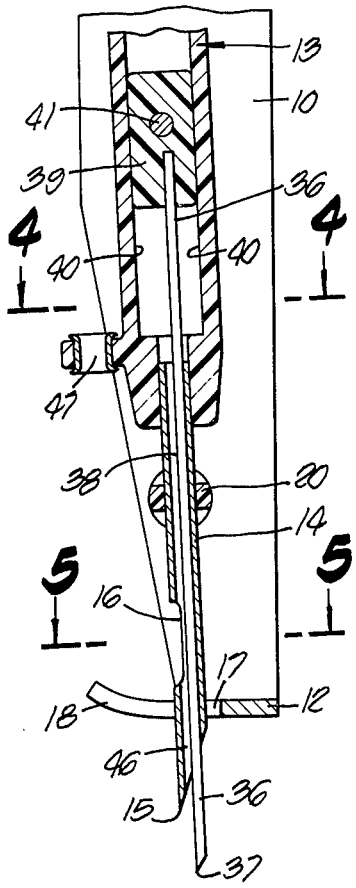
FIG. 3 is a sectional view partly broken away, taken substantially on the lines 3—3 as shown in FIG. 2.
Figure 4:
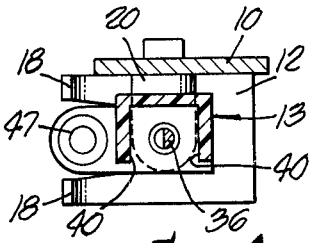
FIG. 4 is a transverse sectional detail taken substantially on the lines 4—4 as shown in FIG. 3.
Figure 5:
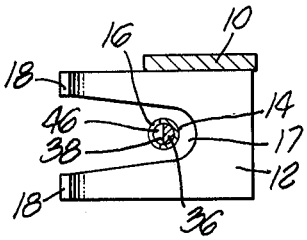
FIG. 5 is a transverse sectional detail taken substantially on the lines 5—5 as shown in FIG. 3.

Referring to the drawings, a support plate 10 is a metallic plate having a grip handle 11 mounted at the upper end and having a bifurcated foot piece 12 mounted at the other end. A body 13 is mounted to oscillate with respect to the support plate 10, and this body 13 has a hollow needle 14 fixed thereto and moving as a unit therewith. The lower end of this hollow needle 14 is pointed at 15 and it is provided with a window 16. The lower end of the hollow needle 14 passes through the space 17 between the laterally extending projections 18 of the foot piece 12.

A guide ring 20 fixed on the support plate 10 has a central opening which slidably receives the outer surface of the hollow needle 14, and there is sufficient clearance to permit orbital movement of the upper end 21 of the body 13. This orbital movement is generated by means of a circular disk 22 fixed in an offcenter position with respect to a pinion shaft 23 extending through and mounted to turn on the support plate 10. A floating washer 24 encircles the pinion shaft 23 and is confined between the side surface of the support plate 10 and the circular eccentric disk 22. A pinion gear 25 is fixed on the pinion shaft 23 and is mounted on the other side of the support plate 10. The pinion gear meshes with a driving gear 26 fixed on a hub 27 mounted to turn on the bearing sleeve 28. A stationary retainer screw 29 is threaded into the support plate 10 and holds the bearing sleeve 28 and the hub 27 in position. A crank assembly 31 has a crank arm 32 fixed to the hub 27. A cover guard 33 encloses the gears 25 and 26 and is held in place on the support plate 10 by means of the threaded fastenings 34.

From this description it will be understood that manual operation of the crank assembly 31 causes the gear 26 to turn the gear 25, thereby rotating the eccentric disk 22 within the circular pocket 35 formed in the upper end 21 of the oscillatory body 13. As the upper end of the body moves in an orbital path, the lower end is slidably guided by the guide ring 20, with the result that the lower pointed end 15 of the hollow needle 14 moves up and down, together with a slight back-and-forth movement within the space 17 on the foot piece 12.

A solid inner needle 36 extends through the hollow needle 14 on the body 13 and has a pointed lower end 37 which is slightly convex. This needle 36 is half round is cross-section and has a flat side 38. The upper end of the solid needle 36 is fixed within a slide block 39 mounted to slide between the parallel guide surfaces 40 on the oscillatory body 13. This block is connected by a pin 41 to the lower end of a link 42; the upper end of the link 42 is pivotally connected by pin 43 to the rotary arm 44 fixed to the pinion shaft 23. The pin 43 may be mounted in any one of a series of openings 45 provided on the arm 44, in order to control the length of the stroke of the solid inner needle 36. In normal operation, the travel of the inner needle 36 is from an upper limit above the window 16 to a lower limit below the lower end of the hollow needle 14. The space 46 within the hollow needle 14 and the flat side 38 of the inner solid needle 36 provides clearance for yarn (not shown) passing through the yarn guide 47 and entering the interior of the hollow needle 14 through the window 16.

The grip handle assembly 11 includes duplicate extensions 48 and 49 projecting in opposite directions from the upper end of the support plate 10, and clamped together by the fastener 50. The extensions 48 and 49 may be tapered to diminish in size toward their extending ends, and their outer surfaces may be provided with longitudinal serrations. The grip handle assembly 11 is grasped in one hand of the user, some of the fingers of the hand being located on one side of the support plate 10 and other fingers located on the other side. The other hand of the user turns the crank assembly 31. The position and configuration of the grip handle assembly 11 enables the user to swing the entire tool in a forward or rearward direction to control the length of the stitch.

The half round inner needle 36 has its upper end force-fitted into a recess of the same shape provided in the slide block 39. This needle is cut from wire. The hollow outer needle 14 is cut from tubing and is force-fit into the lower end of the body 13.

In operation, the pointed end 15 of the hollow needle 14 pierces the backing member (not shown) and extends to the lower side thereof, while the solid inner needle 36 moves a loop or tuft of yarn so that it is exposed on the lower side of the backing member. Continued operation of the hand crank 31 reciprocates the inner and outer needles in their timed cycle to form a loop or tuft for each complete stroke. The entire device is moved manually in lateral directions to produce the desired pattern of tufts on the backing member.

In practice, the parts 13, 20, 33, 39 and 42 are formed of plastic materials to provide for easy sliding movement without lubrication. Also, static electricity is not generated.

Having fully described our invention, it is to be understood that we are not to be limited to the details herein set forth but that our invention is of the full scope of the appended claims.

We claim:

1. In a hand powered tufting machine adapted to be manually supported and guided over a base fabric, the combination of: a support plate, a manual crank and gearing driven thereby mounted on one side of said support plate, a rotary eccentric on the other side of said support plate driven by said gearing, a grip handle at the upper end of the support plate having extensions extending laterally in opposite directions from the support plate and parallel to the axis of the crank for manual support and movement of the device, a body having its upper end encompassing said eccentric to provide orbital movement, said body having parallel guide surfaces extending longitudinally, a hollow needle fixed to the lower end of the body, a stationary guide ring on said support plate slidably guiding said hollow needle, a crank arm adjacent said rotary eccentric driven by said gearing, a slide block guided for longitudinal movement between said parallel guide surfaces on said body, a solid inner needle fixed to said slide block and extending through said hollow needle, the hollow needle having a yarn-receiving window near its lower end, and a link connecting said crank arm to said slide block, whereby said inner needle may be caused to reciprocate from a position above said window to a position below the lower end of hollow needle.

2. The combination set forth in claim 1 in which the solid inner needle is formed of half-round wire press-fitted into said block.

* * * * *